US012049750B2

(12) United States Patent
Muller et al.

(10) Patent No.: US 12,049,750 B2
(45) Date of Patent: Jul. 30, 2024

(54) GUTTER SYSTEM

(71) Applicant: ACO AHLMANN SE & CO. KG, Budelsdorf (DE)

(72) Inventors: Michael Muller, Monkeberg (DE); Michael Sieber, Timmaspe (DE); Arne Stoltenberg, Budelsdorf (DE)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 186 days.

(21) Appl. No.: 17/756,381

(22) PCT Filed: Nov. 24, 2020

(86) PCT No.: PCT/EP2020/083161
§ 371 (c)(1),
(2) Date: May 24, 2022

(87) PCT Pub. No.: WO2021/105098
PCT Pub. Date: Jun. 3, 2021

(65) Prior Publication Data

US 2022/0389703 A1 Dec. 8, 2022

(30) Foreign Application Priority Data

Nov. 27, 2019 (DE) ..... 102019132117.4

(51) Int. Cl.
*E03F 5/06* (2006.01)

(52) U.S. Cl.
CPC ..... *E03F 5/06* (2013.01); *E03F 2005/065* (2013.01)

(58) Field of Classification Search
CPC ..... E03F 5/06; E03F 1/00; E03F 5/04; E03F 2005/063; E03F 2005/065; E02B 5/00
See application file for complete search history.

(56) References Cited

U.S. PATENT DOCUMENTS 7,293,937 B2 * 11/2007 Fuchs ..... E05D 7/1077 404/2
9,689,135 B2 * 6/2017 Canney ..... E05C 19/06
2007/0122237 A1 * 5/2007 Blaschke ..... E03F 5/06 405/118

FOREIGN PATENT DOCUMENTS

CH 708 641 A2 3/2015
CN 109072599 A 12/2018
CN 1090844328 A 6/2019
(Continued)

OTHER PUBLICATIONS

International Search Report issued in corresponding International PCT Application No. PCT/EP2020/083161; Mailing date: Feb. 19, 2021.

(Continued)

*Primary Examiner* — Sean D Andrish
(74) *Attorney, Agent, or Firm* — Pearne & Gordon LLP

(57) ABSTRACT

The invention relates to a gutter system (1) with at least one frame unit (10), at least one cover unit (20) and at least one first damping element (14), wherein the frame unit (10) has at least one receiving area (12) for arranging the cover unit (20). The receiving area (12) of the frame unit (10) has at least three side walls (12.1; 12.2; 12.3; 12.4; 12.5), wherein the first damping element (14) is provided between the frame unit (10) and the cover unit (20) in such a way that the cover unit (20) is received in the frame unit (10) in a damping manner in at least three spatial directions.

10 Claims, 10 Drawing Sheets

(56) References Cited

FOREIGN PATENT DOCUMENTS

| | | | | |
|---|---|---|---|---|
| CN | 110382796 | A | | 10/2019 |
| DE | 20 2005 010 323 | U1 | | 10/2005 |
| DE | 10 2009 019 375 | A1 | | 11/2009 |
| DE | 20 2010 000 132 | U1 | | 6/2010 |
| DE | 20 2010 017 019 | U1 | | 5/2012 |
| KR | 20110002525 | | * | 1/2011 |
| KR | 20180040385 | A | | 4/2018 |
| RU | 163464 | U1 | | 7/2016 |
| WO | 02075066 | A1 | | 9/2002 |
| WO | 2005035889 | A1 | | 4/2005 |

OTHER PUBLICATIONS

The First Office Action issued in corresponding Chinese Application No. 202080081739.3; Dated: Mar. 26, 2024.

* cited by examiner

GUTTER SYSTEM

FIELD OF THE INVENTION

The invention relates to a gutter system with at least one frame unit, at least one cover unit and at least one damping element.

BACKGROUND OF THE INVENTION

In conventional gutter systems for drainage, the cover or grate unit is connected or interlinked with the frame unit. In this way, the grate or cover unit is to be secured in the frame unit from falling out and/or being lifted out.

However, thick-walled gutter systems, in particular, require a large grate width and thus increased costs in the manufacture of such cast grates. Furthermore, the frame unit or the gutter wall itself must be modified and designed using additional geometries in such a way that it is possible to intervene in the wall. In addition, the direct contact of the cast grate or the cast cover on the frame unit causes an unsteady grate position.

BRIEF SUMMARY OF THE INVENTION

It is the object of the present invention to provide a gutter system which can be produced simply and inexpensively, an optimized grate or cover support, which enables easy assembly on site and at the same time provides easy maintenance.

The invention relates to a gutter system with at least one frame unit, at least one cover unit and at least one first damping element, the frame unit having at least one receiving area for the arrangement or receiving of the cover unit, the receiving area of the frame unit being composed of at least three side walls, preferably five side walls. The first damping element is provided between the frame unit and the cover unit such that the cover unit is received in the frame unit or in the at least one receiving area of the frame unit in a damping manner in at least three spatial directions, preferably in at least five spatial directions.

The invention is based on the basic idea that the frame unit has an area for positioning and receiving, which is designed by means of a first damping element in such a way that an inserted cover or grate unit is mounted in a damped manner in at least three spatial directions when it is used as intended. Thus, for example, for cast-iron cover and frame units of a gutter system, in particular a steady grate or cover position can be provided.

According to the invention, the at least one receiving area can be formed by at least three side walls. In particular, the cover unit can be inserted into the receiving area of the frame unit. In particular, the cover unit can rest on a first, second or third side wall.

The at least three side walls of the at least one receiving area are preferably designed in such a way that the cover unit is encompassed on three sides.

Particularly preferably, the at least one receiving area can be designed with five side walls, so that the cover unit can be introduced into the receiving area via one side and is encompassed on five sides by the side walls of the receiving area.

Furthermore, the first damping element between the frame unit and the cover unit is designed in such a way that the cover unit is mounted in the frame unit in a damped form in at least three spatial directions.

The cover unit can preferably be mounted or received in the at least one receiving area in a damping manner in four spatial directions or in five spatial directions.

If two opposing receiving areas of the frame unit are formed for receiving or mounting the cover unit on two sides, the result is a damped mounting or receiving of the cover unit in at least four spatial directions, preferably in all six spatial directions.

Particularly preferably, it is provided that the cover unit, in consideration of the alignment or orientation according to the use, is mounted in the frame unit upwards in the vertical direction and in the longitudinal direction of the gutter system in a damped manner on both sides. This results in damping along three sides or spatial direction and, in particular, in securing the cover unit against displacement in the longitudinal direction of the gutter system.

If a gutter system is designed with a circular cover unit, it may also be possible to provide a damped mounting of the cover unit with a single receiving area of the frame unit.

In the sense of the present invention, the at least one first damping element is formed in the receiving area of the frame unit in order to provide a damped mounting of the cover unit in several spatial directions. A steady grate position or cover position for the gutter system can thus be achieved.

According to one embodiment, the receiving area of the frame unit with the at least three side walls is designed as an undercut, so that the cover unit is at least partially encompassed by the frame unit along at least three sides.

Thus, the cover unit can be inserted into the undercut receiving area of the frame unit, the undercut geometry essentially preventing the cover unit from falling out or being lifted out. Rather, it is preferably provided that the receiving area allows the cover unit to be removed exclusively in the opposite direction to the insertion of the cover unit.

In particular, due to the design of the at least one receiving area of the frame unit with at least three side walls as an undercut, a locking function, a sliding preventing function and a damping function can be provided for the cover unit.

A secure and appropriate arrangement of the cover unit in the frame unit can thus be achieved.

In a further embodiment, the cover unit has at least one engagement element for engagement in the receiving area of the frame unit. In particular, the engagement element can be designed as a nose-shaped projection on the frame unit. The cover unit can thus be securely inserted and positioned in the corresponding receiving area of the frame unit.

According to a preferred embodiment, the cover unit is designed in combination with at least one movably configured securing element, so that the moveable securing element can be moved for at least temporary engagement in the receiving area of the frame unit. In particular, the securing element can be translationally movable or can be rotationally movable through at least 90°.

In this sense, the cover unit can have a movably configured securing element and a fixed engagement element.

The securing element can be designed, for example, as a resiliently mounted interlocking element or an interlocking element that can be fixed in the form of a screw, for reaching the receiving area or the undercut receiving area from below or from behind. In particular, the at least one securing element of the cover unit can be designed as a sliding bolt, a spring-snap bolt in the sense of a door lock principle, as a fastener or the like.

According to one embodiment, the at least one first damping element is provided along at least three of the side walls of the receiving area of the frame unit, or as an attachment for arrangement on the cover unit, in particular on the at least one engagement element.

Thus, a damped mounting or receiving of the cover unit in the at least one receiving area can be provided in at least three spatial directions, preferably in five spatial directions, in that the side walls can be configured with the first damping element.

Alternatively, the at least one first damping element can be formed along the cover unit. In particular, the at least one engagement element of the cover unit can be formed with the first damping element so that damping can be provided between the frame unit and the cover or grate unit in at least three spatial directions, preferably five spatial directions.

In one embodiment, the at least one first damping element is provided as a surface coating or as at least one insert for positioning along the receiving area.

Thus, the first damping element can be designed or applied in the form of a surface coating, in particular along the three side walls in the receiving area of the frame unit. Furthermore, it is possible for the first damping element to be provided as an insert which is at least temporarily introduced into the receiving area along the side walls.

Alternatively, the at least one engagement element of the cover unit can have a surface coating or an attachment to provide the first damping element within the meaning of the invention. Furthermore, it is conceivable that the at least one engagement element consists of a polymer, for example, and acts as a whole as a first damping element.

In one embodiment, at least one second damping element 14.2 is provided along a side surface of the cover unit facing the frame unit, preferably on a side of the frame unit opposite the arranged, first damping element, in particular when the gutter system is assembled.

In particular, the second damping element can be applied as a surface coating or a surface layer on the cover unit, so that at least one of the side surfaces facing the frame unit is damped. Additional damping is thus available in particular in one spatial direction by means of the second damping element along the cover unit.

A two-sided damping of the cover unit is also conceivable by means of the second damping element.

According to a preferred embodiment, the first damping element and/or a second damping element are arranged such that the cover unit is received in the frame unit in a damping manner on side walls of the receiving area in the longitudinal direction of the gutter system.

In this way, in particular a displacement of the cover unit in the longitudinal direction of the gutter system can be prevented and/or dampened. As a damping in at least one third spatial direction, damping in the vertical direction upwards can be provided, for example.

According to a further preferred embodiment, the first damping element and/or a second damping element has a plastically and/or elastically deformable material, in particular a polymer.

The damping element can particularly advantageously have a plurality of recesses into which corresponding thickened areas of the cover unit engage and thus enable the damping elements to be securely seated on the cover unit. In addition, the at least one damping element can have an undercut on its upper and/or lower leg in order to additionally improve the fastening to the thickened areas of the cover unit.

The cover unit and the frame unit can be made of metal, in particular cast iron, or of comparable, suitable materials for forming a gutter system for drainage.

Accordingly, a plastically and/or elastically deformable material of the at least one first and/or second damping element can provide appropriate damping between the frame unit and the cover unit, among other things to achieve a steady grate or cover position.

According to a further embodiment, the frame unit has at least one displacement safety by means of an insert as the first damping element, the insert engaging the cover unit in such a way that a displacement safety is provided in the longitudinal direction of the gutter system.

The at least one displacement safety can be designed to interact or engage with the at least one engagement element of the cover unit.

Alternatively, displacement securing elements, for example in the form of support ribs or intermediate ribs or the like, can be provided along the extension of the at least one, preferably undercut, receiving area in the direction of a longitudinal axis of the gutter system. Thus, different sections of a longitudinally extending receiving area of the frame unit can be designed with five side walls each.

An expedient protection against displacement of the cover or grate unit can be provided.

In one embodiment, the frame unit is designed symmetrically to a longitudinal axis of the gutter system.

Thus, the cover unit can be used alternately with the frame unit, wherein the cover unit can be configured asymmetrically. A direction-dependent assembly of the cover and frame unit is preferably not provided.

BRIEF DESCRIPTION OF THE DRAWINGS

The invention is explained in detail below with reference to the accompanying drawings.

In particular, schematically.

DETAILED DESCRIPTION OF PREFERRED EMBODIMENTS

Figure 1:
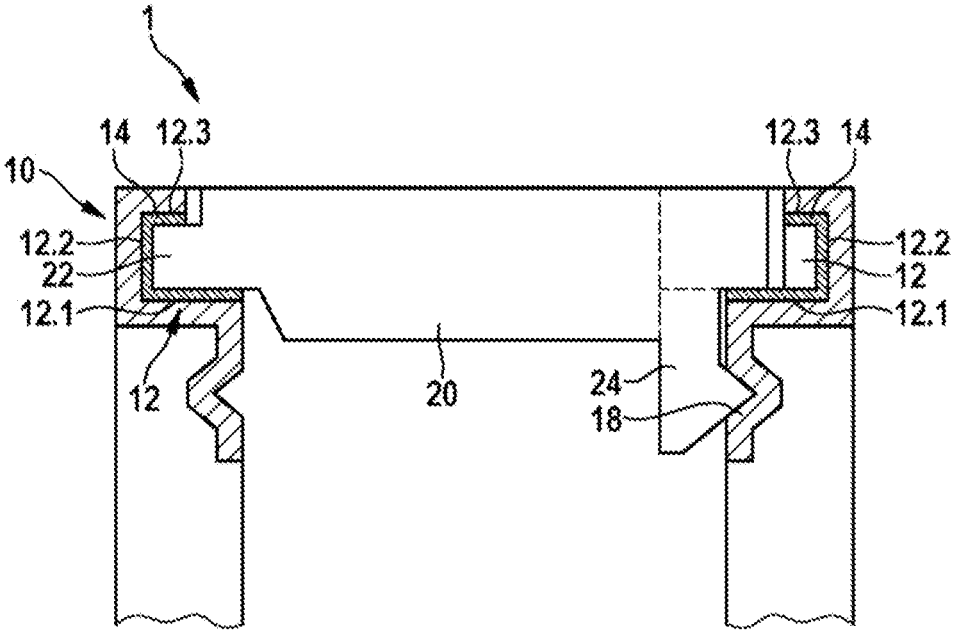
FIG. 1 is a cross-sectional view of a gutter system according to a first embodiment.

FIG. 1 shows a cross-sectional view of a gutter system 1 according to a first exemplary embodiment. The gutter system 1 has a frame unit 10 and a cover unit 20.

The frame unit 10 is provided with undercut receiving areas 12 on both sides. The receiving areas 12 are formed by a first, second and third side wall 12.1; 12.2; 12.3 formed by at least three side walls.

Along the three side walls 12.1; 12.2; 12.3, a damping element 14 is provided. The damping element 14 can be provided as a surface coating or as an insert 16 (cf. FIG. 2).

According to FIG. 1, the cover or grate unit 20 has at least one engagement element 22 which is provided for engagement in an undercut receiving area 12 of the frame unit 10. The damping element 14 is formed between the frame unit 10 and the cover unit 20.

The cover unit 20 can be designed with at least one engagement element 22 on one side or on both sides. According to FIG. 1, a one-sided design of the engagement element 22 on the cover unit 20 is provided. In this sense, the cover unit 20 can be designed asymmetrically.

Furthermore, according to FIG. 1, a non-positive and/or positive connection of the cover unit 20 to the frame unit 10 is provided. In addition, the frame unit 10 has first bracing elements 18, which can be designed as a V-shaped groove symmetrically along a longitudinal axis of the gutter system 1. A reciprocal or direction-independent arrangement of the cover unit 20 on the frame unit 10 is thus possible.

The cover unit 20 has at least one securing element 24, in particular in the form of a snap hook with a V-shaped nose for engaging one of the first bracing elements 18. According to FIG. 1, the at least one securing element 24 is provided on the side of the cover unit 20 opposite the engagement element 22. In this way, a releasable non-positive and/or positive connection between cover unit 20 and frame unit 10 can expediently be provided.

By providing the engagement element 22 and the at least one securing element 24 on opposite sides according to FIG. 1, a non-positive and/or positive connection between the frame unit 10 and the cover unit 20 can be brought about in the sense of an at least partially rotational movement of the cover unit 20.

Figure 2:
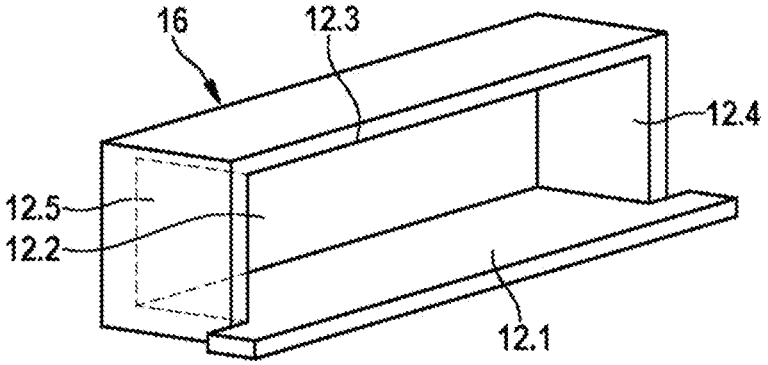
FIG. 2 is a perspective view of an insert for use with a gutter system according to FIG. 1.

FIG. 2 shows a perspective view of an insert 16 for use with a gutter system according to FIG. 1.

The insert 16 can be introduced into one of the receiving areas 12 of the frame unit 10. In this sense, the insert 16 can provide dampened side walls 12.1; 12.2; 12.3; 12.4; 12.5 in different spatial directions, at least in three spatial directions, or serve as damping for intermediate ribs along the receiving area 12.

Furthermore, any arrangement of a plurality of inserts 16 along the receiving area 12 is possible, in particular depending on the positioning of the securing elements 24 along the cover or grate unit 20.

Various views of a second exemplary embodiment of the gutter system 1 are shown in FIGS. 3*a-d*.

Figure 3A:
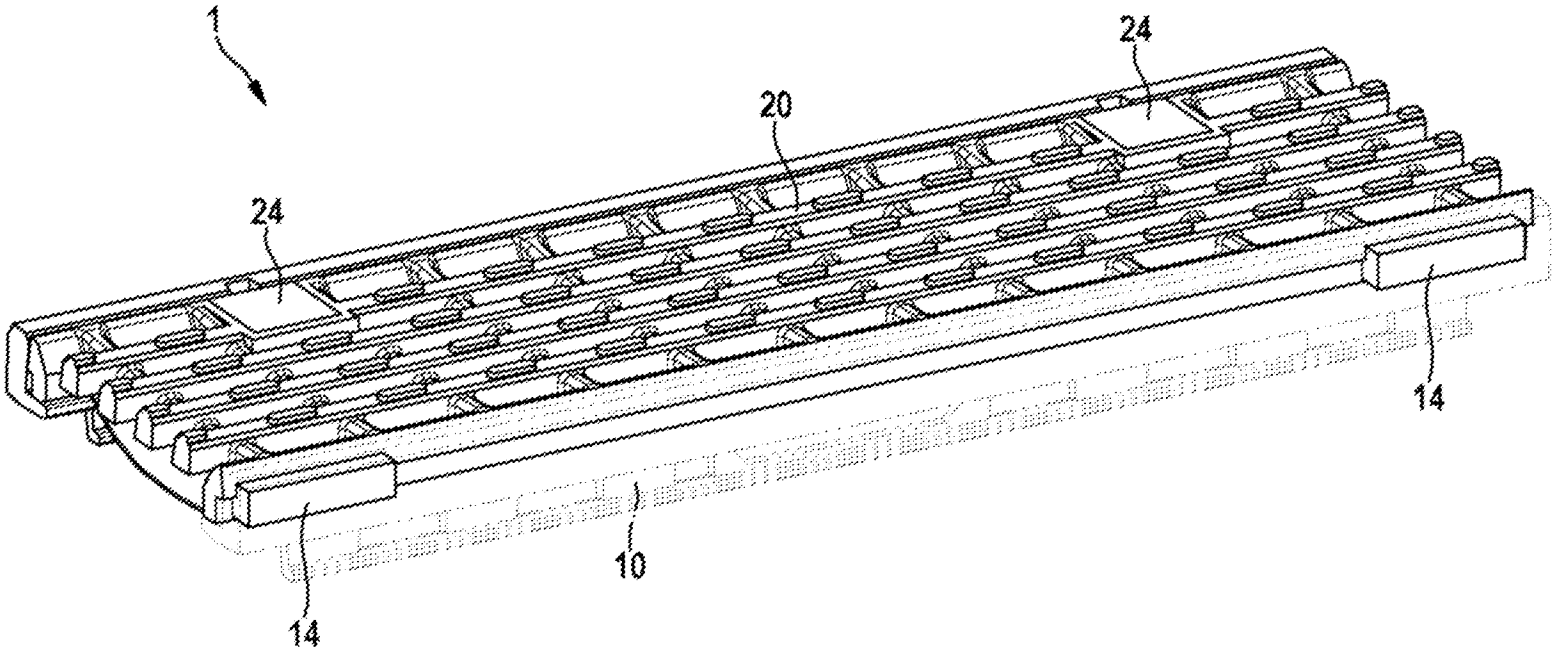
FIGS. 3*a-d* are different views of a second exemplary embodiment of the gutter system.

In particular, FIG. 3*a* illustrates the cover unit with two securing elements 24 and two damping elements 14, which are each spaced apart from one another in the longitudinal direction of the gutter system 1.

The damping elements 14 are accordingly provided for damping the cover unit 20 in sections along the receiving area 12.

In particular, damping in the longitudinal direction of the gutter system 1, with respect to the fourth and fifth side walls 12.4; 12.5 of the receiving area 12 can be provided, which can be divided by intermediate ribs or the like. The intermediate ribs can be used as fourth or fifth side walls 12.4; 12.5. With the aid of such intermediate ribs, a damped securing of the cover unit 20 against slipping in the longitudinal direction of the gutter system 1 can also be provided.

Figure 3B:
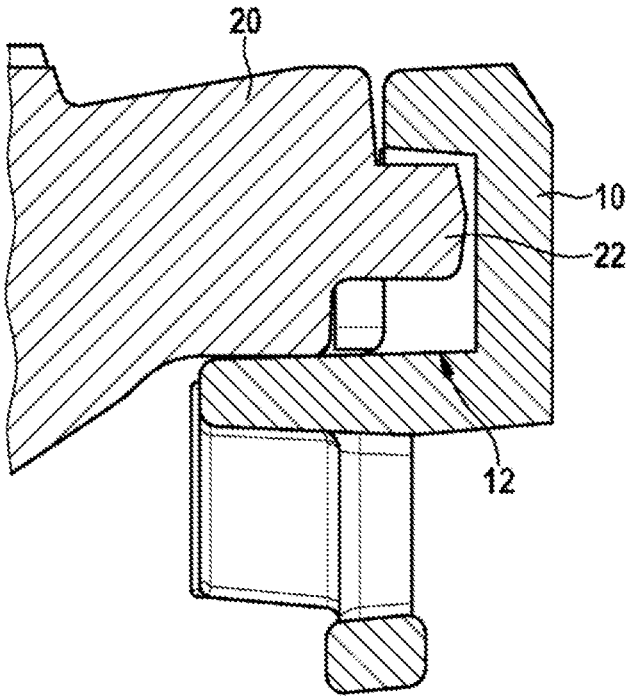

The positioning of the engagement element 22 in the receiving area 12 of the gutter unit 10, which is at least partially undercut, is shown in FIG. 3*b*. In this way, the cover unit 20 cannot be removed from the frame unit 10 in an exclusively vertical direction. The engagement element 22 and the receiving area 12 represent a releasable interlocking.

Figure 3C:
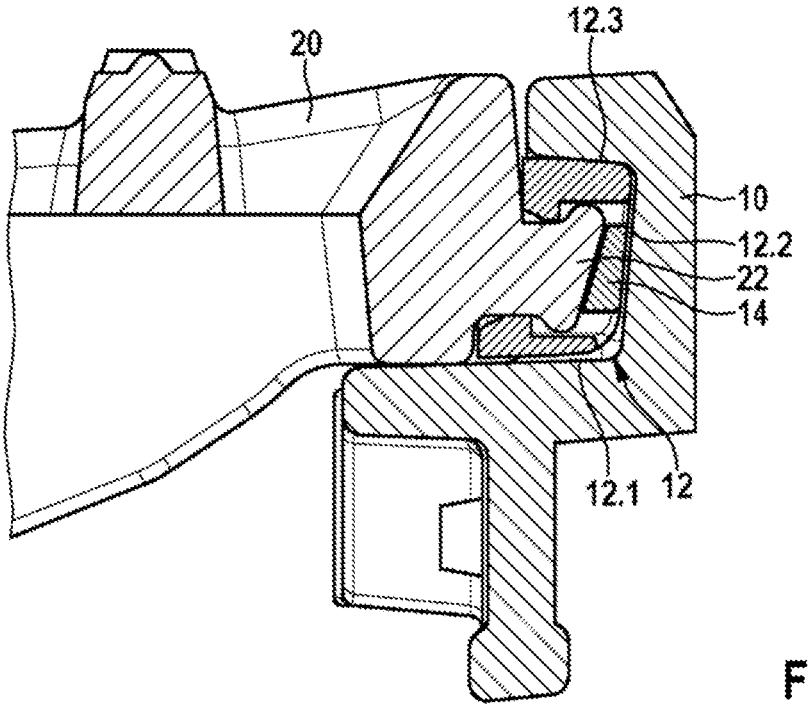

In FIG. 3*c* a damped mounting of the cover unit 20 or the engagement element 22 in the receiving area 12 of the frame unit 10 is shown.

In particular, the engagement element 22 is encompassed by the damping element 14 or the damping element 14 is arranged on the engagement element 22. In this way, damping is particularly possible with respect to the first, second and third side walls 12.1; 12.2; 12.3 of the receiving area 12 of the frame unit 10.

Figure 3D:
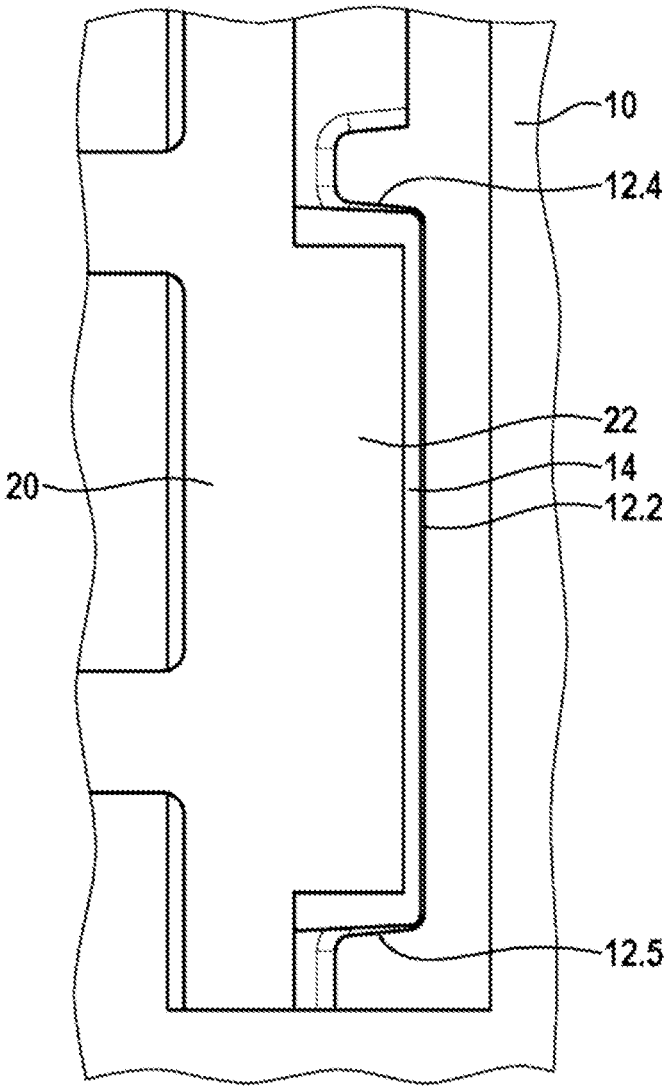

In FIG. 3*d* the damped mounting of the engagement element 22 is shown in the receiving area 12 divided by intermediate ribs.

In particular, the damping element 14 engages around the engagement element 22 of the cover unit 20 in such a way that a displacement safety in the longitudinal direction of the gutter system 1 is provided in a damped form.

Figure 4A:
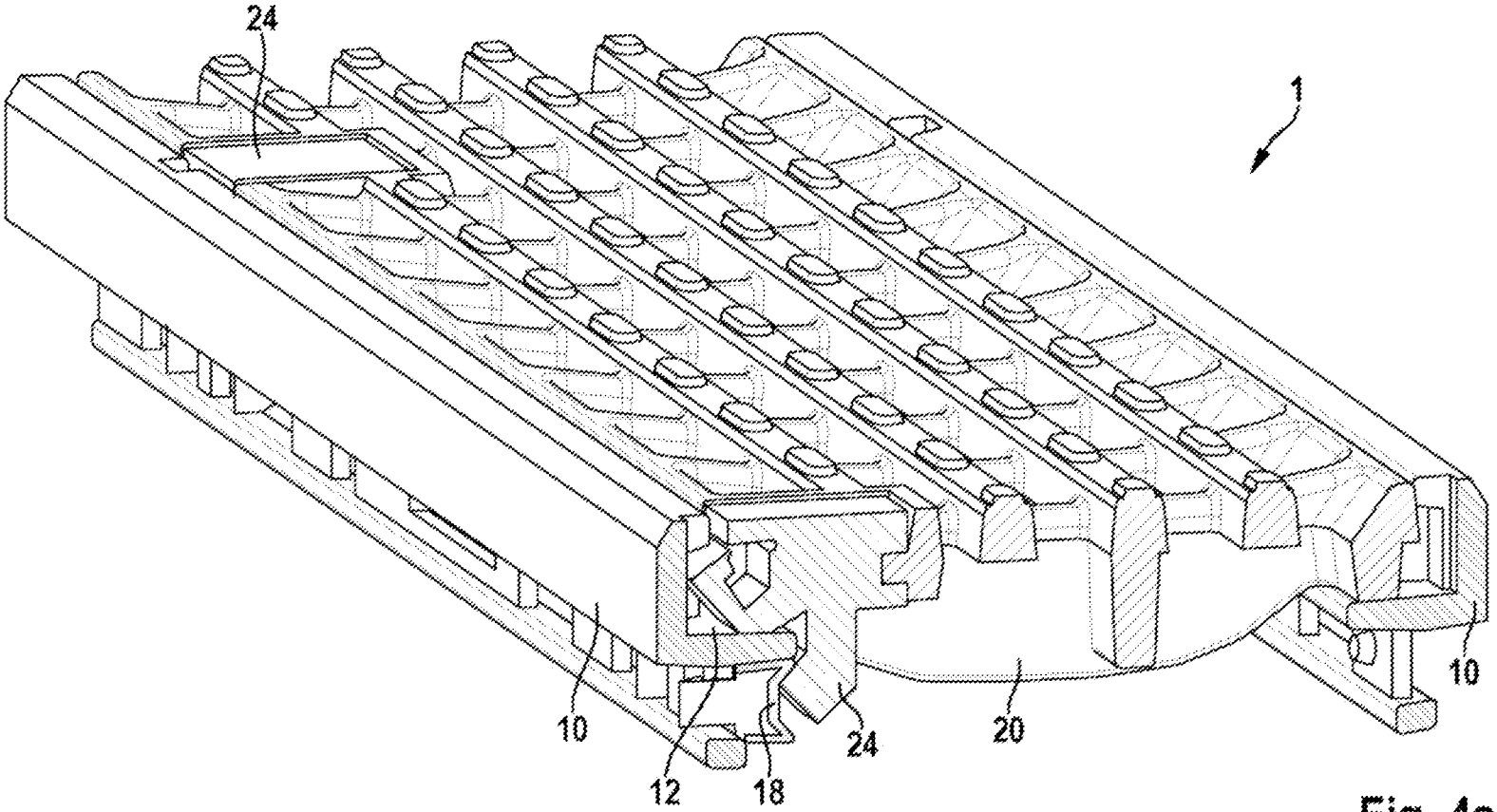
FIGS. 4*a-b* are different views of a third exemplary embodiment of the gutter system.
Figure 4B:
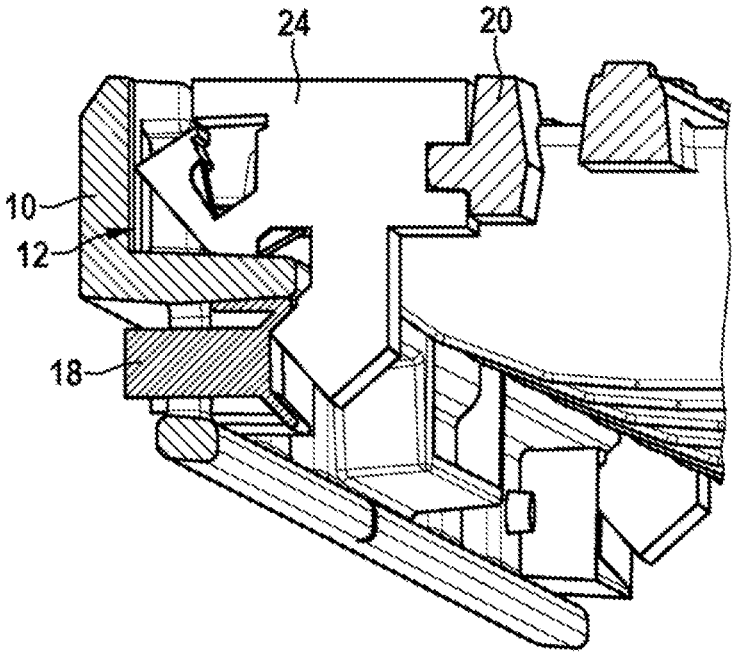

FIGS. 4*a-b* show different views of a third exemplary embodiment of the gutter system 1. In particular, an embodiment of the securing element 24 in the sense of the exemplary embodiment according to FIG. 1 is illustrated.

The securing element 24 engages non-positively and/or positively in the undercut receiving area 12 of the frame unit 10. Furthermore, the securing element 24 engages with a V-shaped nose in the first bracing element 18, which is provided below the receiving area for bracing the securing element 24 in combination with the cover or grate unit 20. In this way, the cover unit 20 can be interlocked on the frame unit 10.

In particular, the at least one first bracing element 18 can be arranged below the receiving area 12 on the frame unit 10 and cast or encapsulated.

The frame unit 10 can preferably be designed symmetrically with the receiving areas 12 on both sides, so that the cover unit 20 with the engagement elements 22 and the securing elements 24 can be inserted on both sides or alternately or independently of direction.

Figure 5:
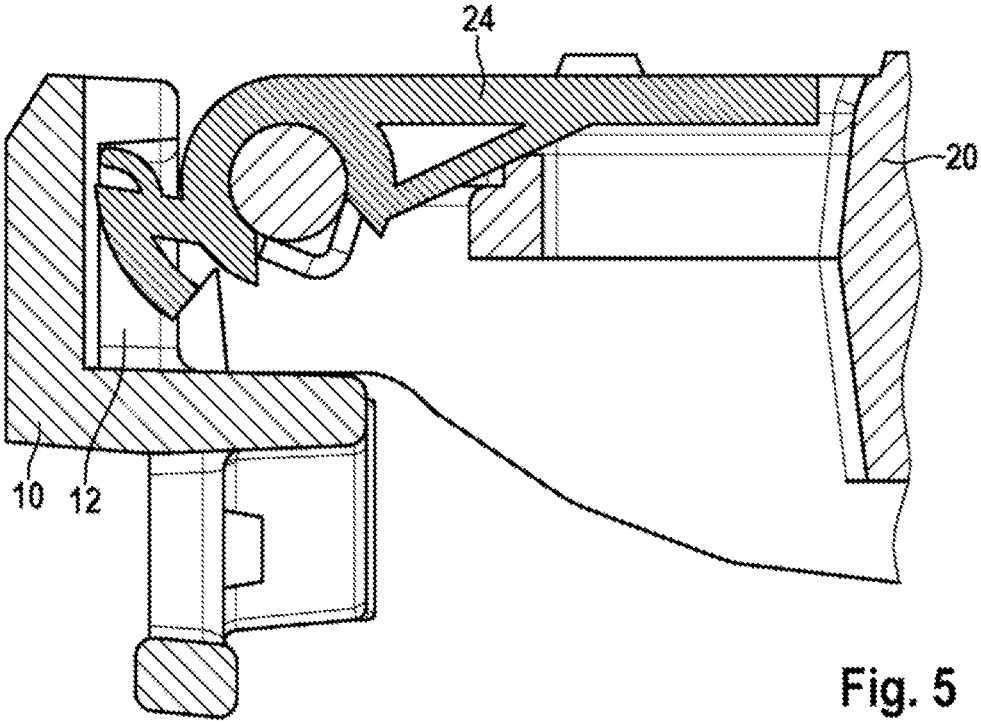
FIG. 5 is a cross section of a fourth exemplary embodiment of the gutter system, in particular a representation of the securing element.
Figure 6A:
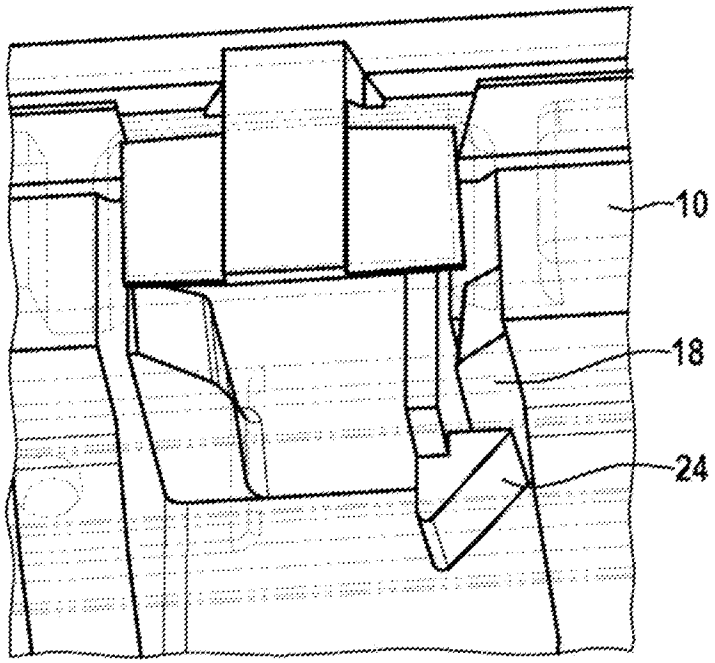
FIG. 6*a* shows a view of the fourth embodiment of the gutter system, in particular a representation of the securing element.
Figure 6B:
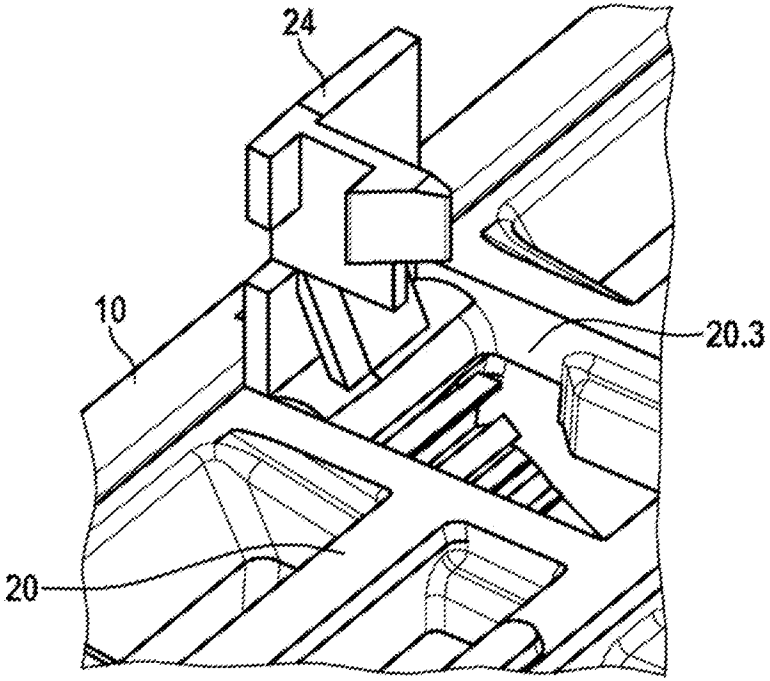
FIG. 6*b* shows a view of the fourth embodiment of the gutter system, in particular a representation of the securing element.

FIG. 5 shows a cross section of a fourth exemplary embodiment of the gutter system 1, in particular a representation of the securing element 24. Various further views of the fourth exemplary embodiment are illustrated in FIGS. 6*a* and 6*b*.

According to FIGS. 5 and 6, the securing element 24 is designed as a rotationally movable securing element 24.

In particular, the securing element 24 is received in a receiving opening 20.3 of the cover unit 20 such that it can move in rotation or is clipped onto a rotary shaft of the cover unit 20.

The axis of rotation of the securing element 24 is aligned on the cover unit 20 in the longitudinal direction of the gutter system 1 and is provided directly adjacent to the receiving area 12 on the cover unit 20. Thus, in the course of a locking rotation, the securing element 24 can engage or rotate into the undercut receiving area 12 of the frame unit 12.

At an opposite end of the securing element 24, which in the locked state protrudes to a central area of the gutter system 1, a latching lug according to FIGS. 6*a* and 6*b* is formed.

The latching lug of the securing element 24 can come into engagement with a first bracing element 18 for locking or interlocking, which is formed on the cover or grate unit 20 in the sense of a projection.

In this way, the securing element 24 can be latched in a blocking position or locking position on the bracing element 18, wherein the securing element 24 on the opposite side of the axis of rotation engages in the undercut receiving area 12. Thus, the cover unit or the grate unit 20 and the frame unit 10 can expediently be interlocked with one another by means of the securing element 24 according to FIGS. 5 and 6.

FIGS. 7*a-d* show different views of a fifth exemplary embodiment of the gutter system 1, in particular a representation of the securing element 24.

Figure 7A:
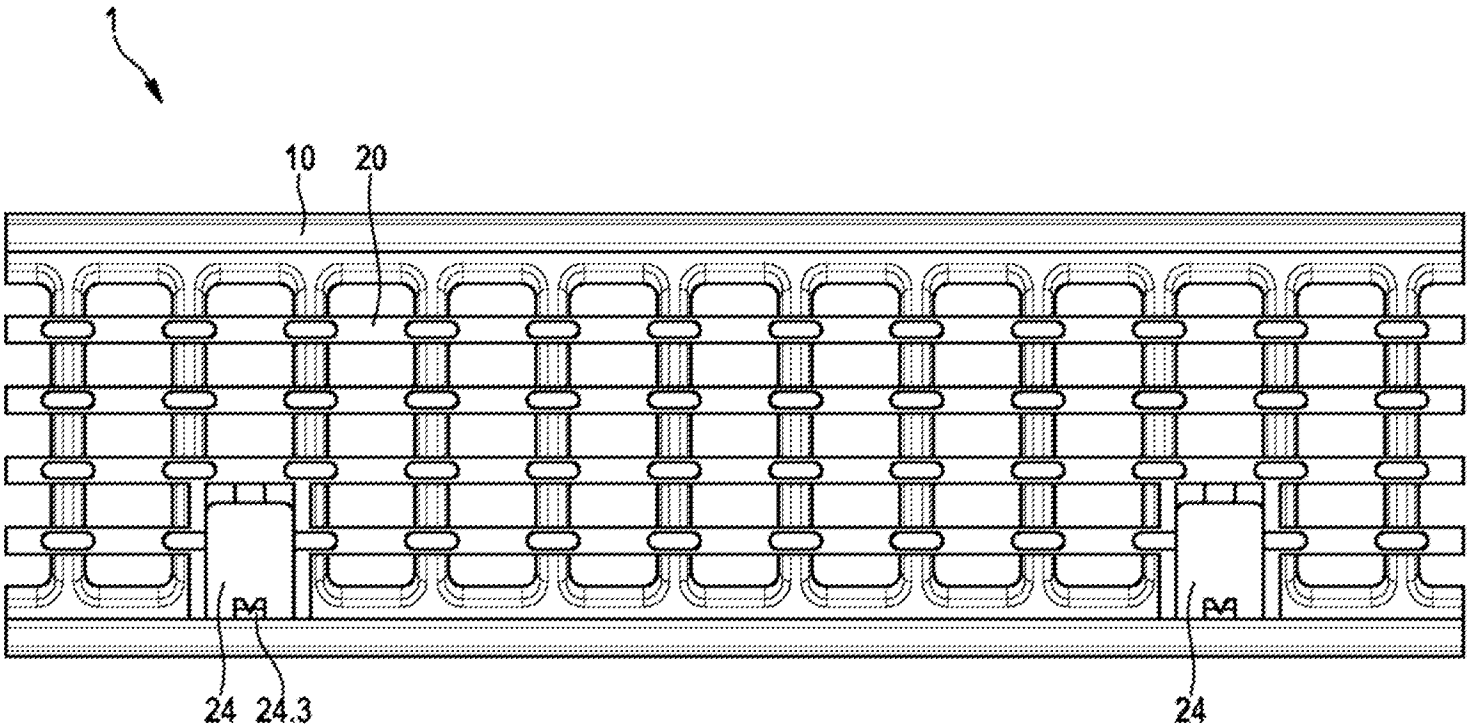
FIGS. 7*a-d* show different views of a fifth embodiment of the gutter system, in a particular representation of the securing element.

According to FIG. 7*a*, the release area 24.3 is formed centrally in the transverse direction of the securing element 24. Furthermore, the securing element 24 can be designed in such a way that it only partially closes the receiving opening 20.3. A plurality of securing elements 24 are provided at a distance from one another in the longitudinal direction of the gutter system 1.

Figure 7B:
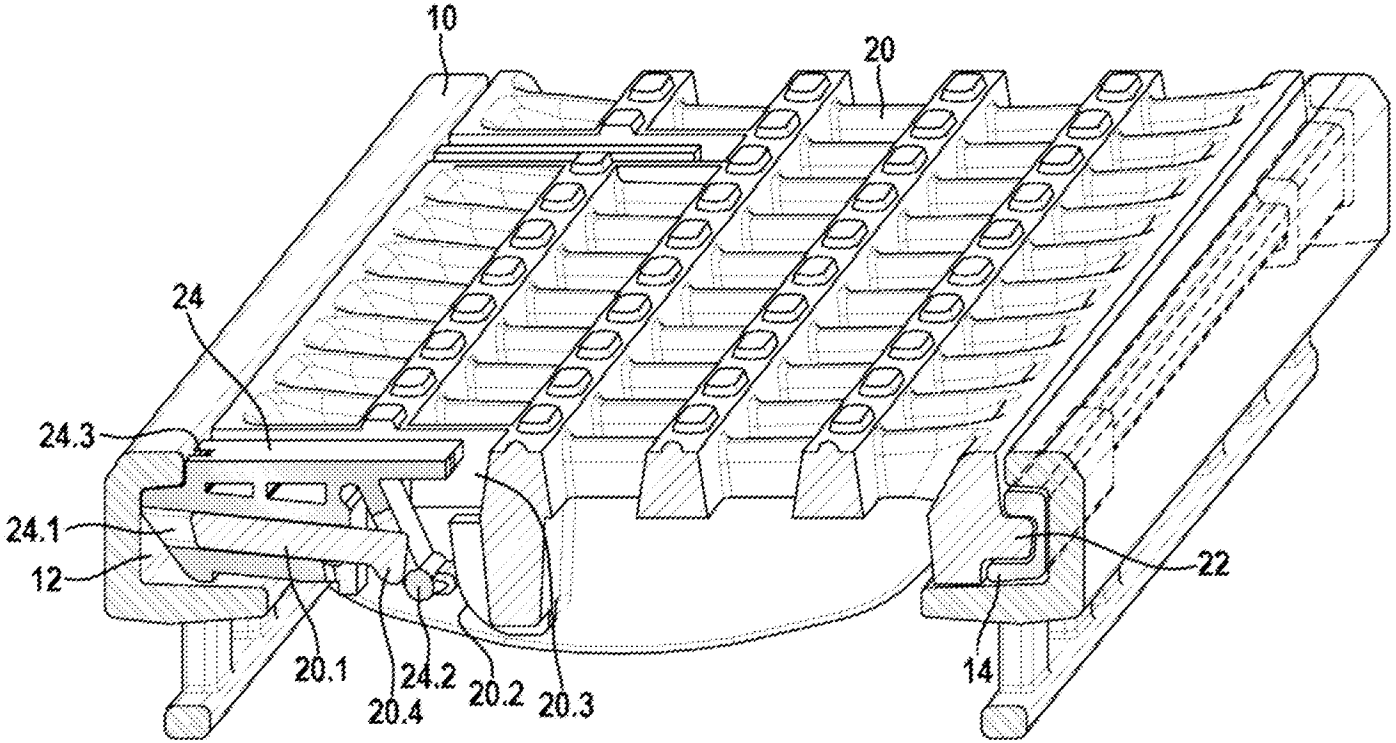

A cross-sectional view of the fifth exemplary embodiment is shown in FIG. 7*b*.

The frame unit 10 is designed with the receiving area 12 for mounting and receiving the cover unit 20. The receiving area 12 is at least partially designed as an undercut or is undercut.

The cover unit 20 has a receiving opening 20.3 for mounting and receiving the securing element 24. Essentially, the receiving opening 20.3 can expand, at least in sections, from top to bottom, along the orientation of the cover unit 20 in normal use. In this way, waste or dirt that can enter the receiving opening 20.3 from above can fall through the cover or grate unit 20.

In addition, the receiving opening 20.3 is formed in a central area of the cover unit 20 or the gutter system 1 with a support surface 20.2. The support surface 20.2 runs essentially in the vertical direction and has a radius or a rounding at least at its lower end.

Furthermore, the frame unit 20 has at least one bearing element 20.1. The bearing element 20.1 extends according to FIG. 1 longitudinally and transversely to the longitudinal direction of the gutter system 1. In particular, the bearing element 20.1 can be designed to be slightly inclined with respect to the horizontal.

The bearing element 20.1 can have loss protection device 20.4 at one end, in particular in the direction of the central area of the gutter system 1. The loss protection device 20.4 can be designed as a bulge or protrusion along the bearing element 20.1. A non-positive and/or positive connection between the cover unit 20 and the securing element 24 is thus available. A captive interlocking is thus provided.

The securing element 24 is inserted in the cover or grate unit 20 according to FIG. 1 and engages with a first end in a non-positive and/or positive manner in the receiving area 12 of the frame unit 10. Since the securing element 24 is configured with a phase along its underside at this first end, the securing element 24 can be locked into the receiving area 12 of the frame unit 10 in a simplified manner.

The securing element 24 is designed with at least one bearing groove 24.1, which is designed to correspond to the bearing element 20.1 of the receiving opening 20.3 of the cover unit 20. The bearing element 20.1 can thus engage in the bearing groove 24.1 in a non-positive and/or positive manner for sliding engagement. Support and guidance of the securing element 24 through the cover unit 20 are available.

Furthermore, the securing element 24 has a closing lever 24.2 at a second end, which is arranged in the central area of the gutter system 1. The closing lever 24.2 is elastically and/or plastically deformable. In particular, the closing lever 24.2 is provided in such a way that it can support itself against the support surface 20.2 of the cover unit 20 in order to apply a closing force to the securing element 24 and thus ensure that it locks or engages in the receiving opening 12 of the frame unit 10.

The securing element 24 can be understood as a spring-loaded securing element 24 in consideration of the preferably elastically deformable closing lever 24.2.

Furthermore, the securing element 30 has the release area 24.3, which is provided for engagement with, for example, a screwdriver, a lever element or the like. In this way, a release force that exceeds the closing force of the locking lever 24, supported on the support surface 20.2, can be applied to the securing element 24 exclusively with the aid of a tool, in order to release the engagement of the securing element 24 in the receiving area 12 of the frame unit 10.

Figure 7C:
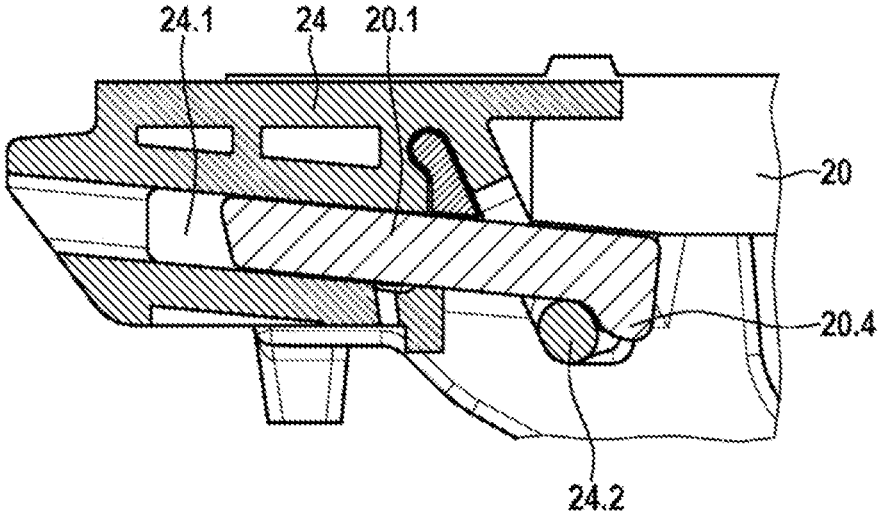
Figure 7D:
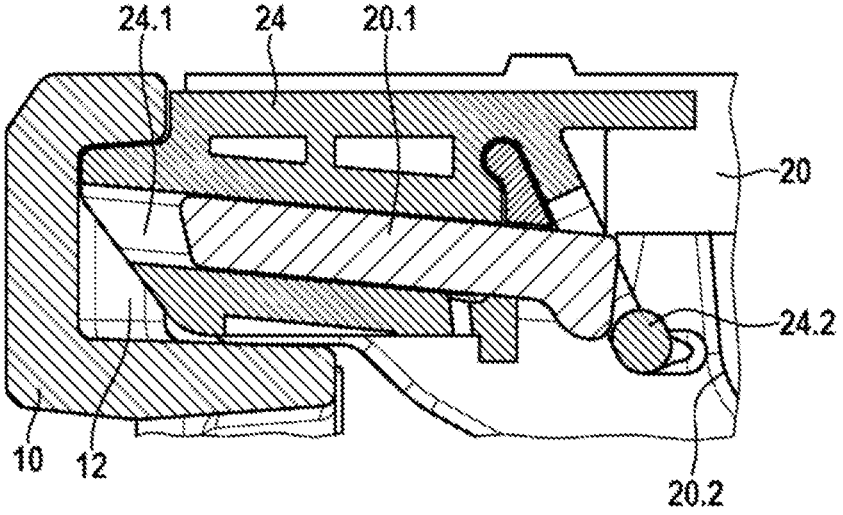

FIGS. 7*c-d* show cross-sectional views of the sixth embodiment, in particular to illustrate the functionality of the securing element 24. In particular, FIGS. 7*c* and 7*d* show the attachment or interlocking of the securing element 24 on the cover unit 20 so that a captive connection is ensured.

The securing element 24 is pushed along the bearing grooves 24.1 and the bearing elements 20.1 into the cover unit 20 or into the receiving opening 20.3 of the cover unit 20.

The locking lever 24.2 also slides along the bearing element 20.1 according to FIG. 7*c*. The locking lever 24.2 can be elastically deformed and slide on the anti-loss device 20.4 of the bearing element 20.1 in such a way that the locking lever 24.2 can snap over and the locking lever 24.2 slides over the anti-loss device 20.4 in the form of a bulge or bulge of the bearing element 20.1.

In this way, according to FIG. 7*d*, the securing element 24 can be latched onto the cover unit 20. A captive connection or interlocking between the cover unit 20 and the securing element 24 can be provided.

Furthermore, the upper side of the securing element 24 can be designed in such a way that the sliding connection between the bearing elements 20.1 and the bearing grooves 24.1 is protected from contamination. The receiving opening 20.3, which is preferably at least partially funnel-shaped in a downward direction, enables dirt and waste to fall through. Blocking of the securing element 24 is thus essentially avoided.

In summary, the present invention makes it possible to provide a gutter system 1 with a simplified and cost-effective structure, with a secure and quiet accommodation of the cover or grate unit 20 along the frame unit 10 being ensured. In particular, a damped and secured or theft-proof mounting of the cover unit 20 on the frame unit 10 can be achieved.

LIST OF REFERENCE NUMERALS

1 gutter system
10 frame unit
12 receiving area
12.1 first side wall
12.2 second side wall
12.3 third side wall
12.4 fourth side wall
12.5 fifth side wall
14 damping element
16 insert
18 first bracing element
20 cover/grate unit
20.1 bearing element
20.2 support surface
20.3 receiving opening
20.4 anti-loss protection

22 engagement element
24 securing element
24.1 bearing groove
24.2 closing lever
24.3 release area

The invention claimed is:

1. A gutter system comprising:
at least one frame unit,
at least one cover unit, and
a plurality of damping elements,
wherein the at least one frame unit has at least one receiving area for arranging the at least one cover unit,
wherein the at least one receiving area of the at least one frame unit has a plurality of side walls,
wherein a first damping element of the plurality of damping elements is provided between the at least one frame unit and the at least one cover unit in such a way that the at least one cover unit is received in the at least one frame unit in a damping manner in at least three spatial directions,
wherein the at least one cover unit includes at least one engagement element for engagement with the at least one receiving area of the at least one frame unit, and
wherein the at least one cover unit includes at least one movable securing element that is separate from and independently movable with respect to the at least one engagement element.

2. The gutter system of claim 1,
wherein the at least one receiving area of the at least one frame unit with the plurality of side walls is designed as an undercut such that the at least one cover unit is surrounded at least partially by the at least one frame unit along at least three sides walls of the plurality of side walls of the at least one frame unit.

3. The gutter system of claim 1,
wherein the at least one movable securing element is movable for the at least temporary engagement into the at least one receiving area of the at least one frame unit.

4. The gutter system of claim 1,
wherein the first damping element is provided along at least three side walls of the plurality of side walls of the at least one receiving area of the at least one frame unit, or
wherein the first damping element is provided as an attachment for arrangement on the at least one cover unit on the at least an engaging element.

5. The gutter system of claim 1,
wherein the first damping element is provided as a surface coating or as at least one insert for positioning along the plurality of side walls of the at least one receiving area of the at least one frame unit.

6. The gutter system of claim 5,
wherein the at least one frame unit is provided by means of an insert as the first damping element with at least one displacement safety device, wherein the insert engages in the at least one cover unit in such a way that a displacement protection is provided in a longitudinal direction of the gutter system.

7. The gutter system of claim 1,
wherein a second damping element of the plurality of damping elements is provided along the plurality of side walls of the at least one receiving area of the at least one frame unit opposite the first damping element.

8. The gutter system of claim 7,
wherein the first damping element or the second damping element are arranged such that the at least one cover unit is accommodated in a damping manner in the at least one frame unit on the plurality of side walls of the at least one receiving area in a longitudinal direction of the gutter system.

9. The gutter system of claim 7,
wherein the first damping element and/or the second damping element has a plastically and/or elastically deformable material.

10. The gutter system of claim 1,
wherein the at least one frame unit is designed symmetrically to a longitudinal axis of the gutter system.

* * * * *